US005456365A

United States Patent [19]

Janssens et al.

[11] Patent Number: 5,456,365

[45] Date of Patent: Oct. 10, 1995

[54] VIBRATORY SCREEN SEPARATOR

[75] Inventors: Eduard X. J. Janssens, Wolvertem, Belgium; Eric K. Johnson, Jr., Edgewood, Ky.

[73] Assignee: Sweco, Incorporated, Florence, Ky.

[21] Appl. No.: 143,693

[22] Filed: Oct. 26, 1993

[51] Int. Cl.[6] ..... B07B 1/49

[52] U.S. Cl. ..... 209/403; 209/405; 209/411

[58] Field of Search ..... 209/399, 403, 209/405, 406, 411, 412

[56] References Cited

U.S. PATENT DOCUMENTS

| | | | |
|---|---|---|---|
| 417,451 | 12/1889 | Victory | 209/405 X |
| 1,026,265 | 5/1912 | Hunnicutt | 209/405 X |
| 1,444,275 | 2/1923 | Robertson | 209/405 |
| 1,448,296 | 3/1923 | Heath | 209/405 X |
| 2,959,285 | 11/1960 | Tonjes et al. | 209/319 |
| 3,035,700 | 5/1962 | McCausland | 209/405 |
| 3,341,013 | 9/1967 | Moulton | 209/405 X |
| 3,508,649 | 4/1970 | Kahane et al. | 209/403 X |
| 4,613,432 | 9/1986 | Racine et al. | 209/254 |
| 4,810,372 | 3/1989 | Jones | 209/315 |
| 4,929,346 | 5/1990 | Si-Lin | 209/405 X |
| 5,152,559 | 10/1992 | Henrichs | 292/113 |
| 5,255,789 | 10/1993 | Janssens et al. | 209/319 |

FOREIGN PATENT DOCUMENTS

| | | | |
|---|---|---|---|
| 97705 | 3/1924 | Australia | 209/403 |
| 80613 | 4/1895 | Germany | 209/403 |
| 220227 | 3/1910 | Germany | 209/403 |
| 335728 | 4/1921 | Germany | 209/403 |
| 0686783 | 10/1979 | U.S.S.R. | 209/403 |
| 14261 | 10/1887 | United Kingdom | 209/403 |
| 7234 | 11/1914 | United Kingdom | 209/403 |
| 141954 | 12/1919 | United Kingdom | 209/403 |
| 202900 | 8/1923 | United Kingdom | 209/403 |
| 638888 | 6/1950 | United Kingdom | 209/403 |
| 676308 | 7/1952 | United Kingdom | 209/405 |

*Primary Examiner*—D. Glenn Dayoan
*Attorney, Agent, or Firm*—Lyon & Lyon

[57] ABSTRACT

A vibratory screen separator using screens with screen frames. The resiliently mounted housing has a first wall portion having an upper edge and a second wall portion above the first wall portion having a lower edge, the upper and lower edges being mutually aligned and defining a seat therebetween to receive a screen frame, each mount being coupled to the first and second wall portions and having a first position with the upper and lower edges gripping the screen frame and second position with the upper and lower edges mutually displaced from the first portion and the screen frame released.

12 Claims, 4 Drawing Sheets

VIBRATORY SCREEN SEPARATOR

BACKGROUND OF THE INVENTION

The field of the present invention is separators for screening materials using vibratory motion for enhanced screening.

Vibratory separators have long been used for the separation of materials, both wet and dry. It is common to use rectangular screen separators and circular screen separators. An example of a rectangular screen separator is illustrated in U.S. Pat. No. 4,582,597 to Huber, the disclosure of which is incorporated herein by reference. A circular separator is illustrated in U.S. Pat. No. 4,613,432 to Racine et. al., the disclosure of which is incorporated herein by reference. Another vibratory separator is illustrated in U.S. Pat. No. 5,226,546, the disclosure of which is incorporated herein by reference. All three of the above-mentioned vibratory separators are provided with an inflatable and deflatable seal running around the edges of the screen frame to avoid material bypassing the screen with the inflatable seal in the inflated condition and to securely locate the screen with the separator housing.

In U.S. Pat. No. 5,226,546, the inflatable seal assists in the facile removal of screens without disassemble of the entire separator. Screens are subject to wear and, under certain adverse conditions, to rupture. Further, in certain applications, different mesh sizes may be required for the same machine. The quick change aspect of this device, therefore, provides substantial operational advantage. However, not all applications are best suited for use of an inflatable mechanism or seal.

SUMMARY OF THE INVENTION

The present invention is directed to facile screen replacement in a vibratory screen separator. This is accomplished by mounts coupled to two portions of a housing. The mounts have operative positions enabling both a sealing of a screen within the housing and a release of the screen therefrom.

In a first and separate aspect of the present invention, the vibratory screen separator uses screens with screen frames. A resiliently mounted housing includes two wall portions, the adjacent edges of the wall portions being mutually aligned and defining a seat to receive a screen frame. The vibratory screen separator is also provided with mounts, each mount being coupled to both wall portions and having at least a first position with the wall portions gripping the screen frame and a second position with the screen frame released.

In another and separate aspect of the present invention, in a separator as described above a resilient member is operatively positioned between the wall portions, substantially relaxed in one position and under compression in a second position. The member is substantially relaxed with latches between the wall portions released and under compression with the latches locked.

In yet another and separate aspect of the present invention, the aforementioned vibratory screen separator may further include a first bracket on a first wall portion and a second bracket on a second wall portion, the resilient member being a compression spring with the latches extending between said first and second brackets.

Thus, an object of the present invention is to provide an improved circular vibratory screen separator. Other and further objects and advantages will appear hereinafter.

DETAILED DESCRIPTION OF THE PREFERRED EMBODIMENT

Figure 1:
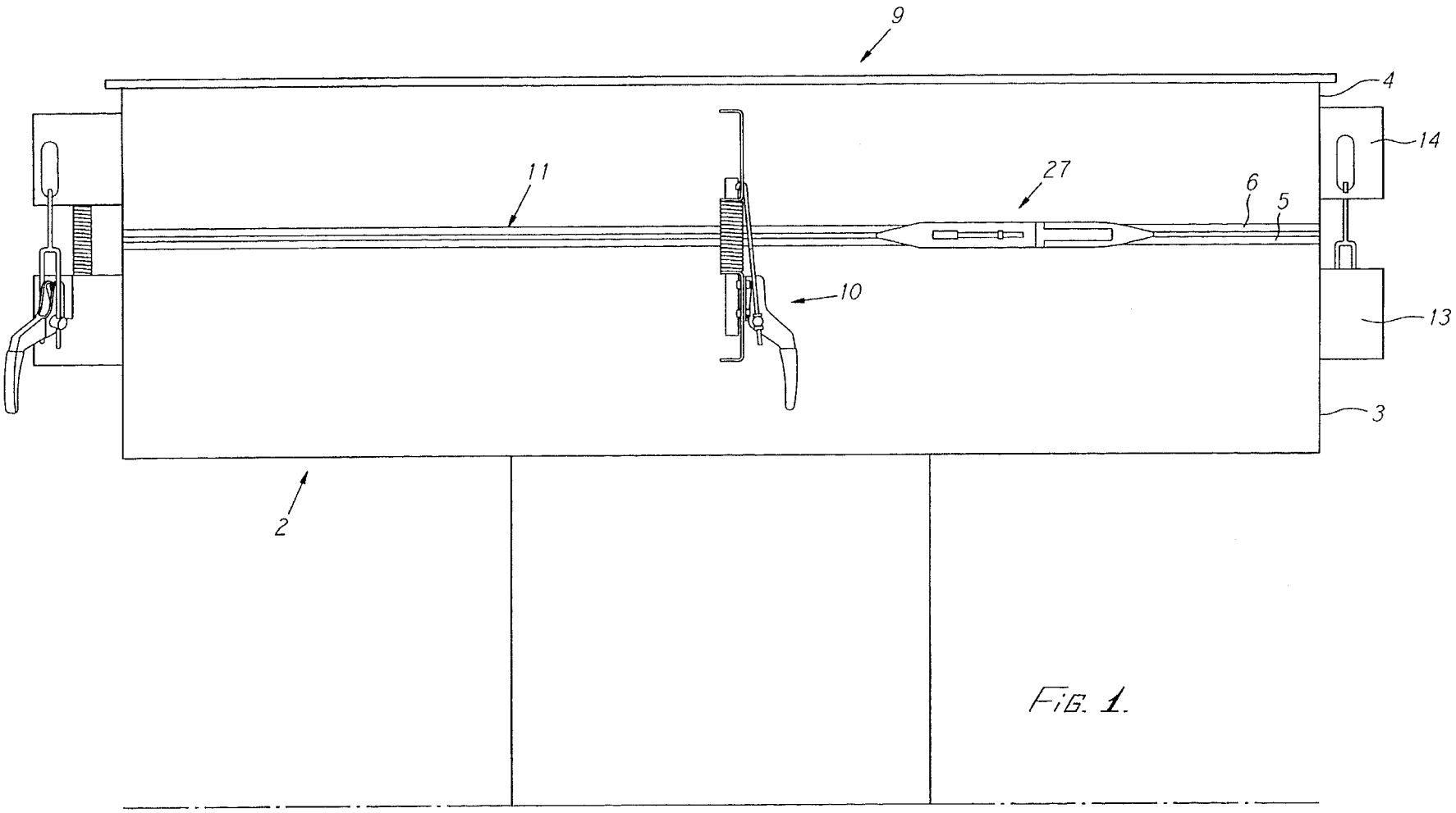
FIG. 1 is a side view of a vibratory screen separator of the present invention.
Figure 2:
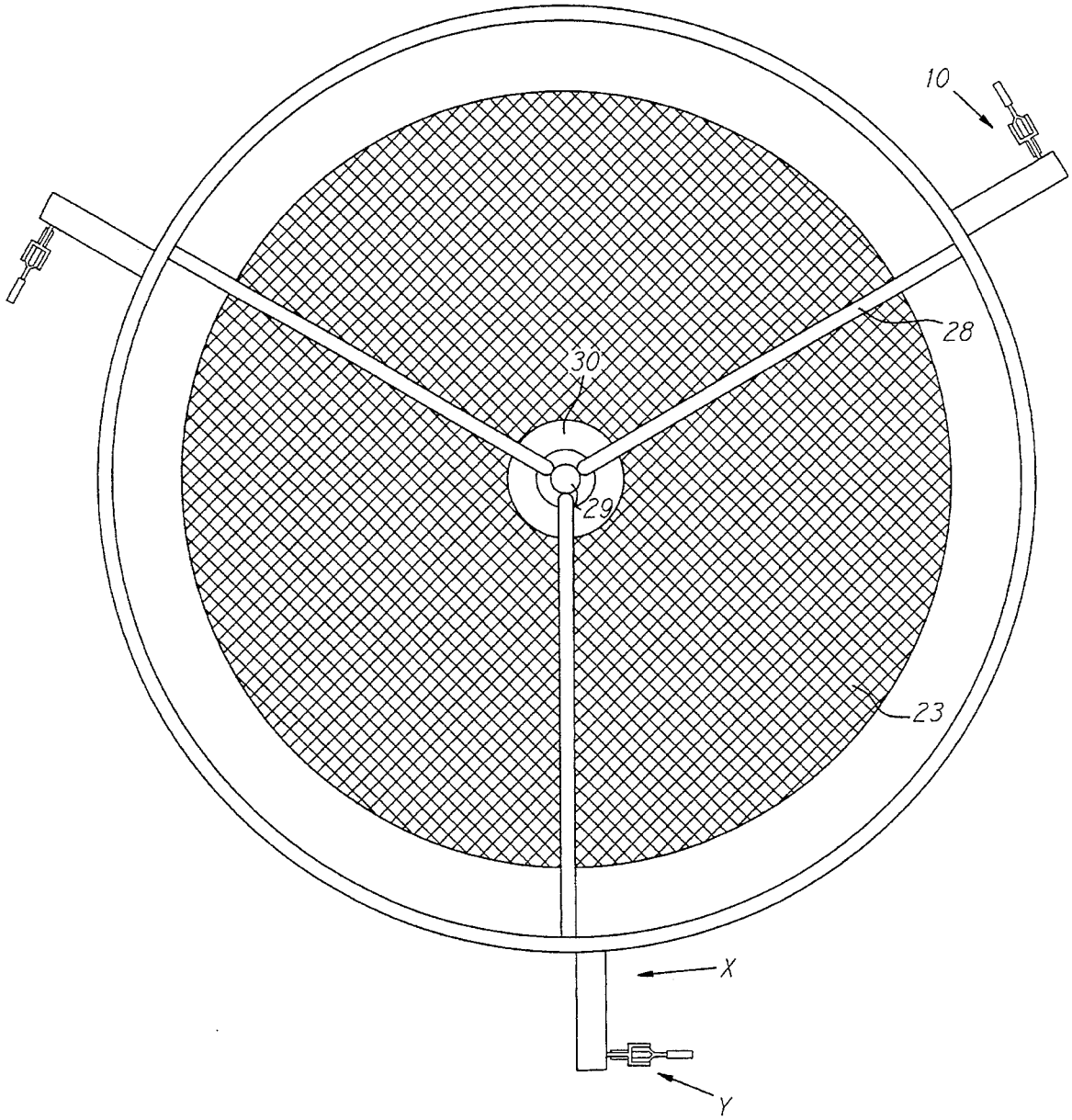
FIG. 2 is a top plan view of the vibratory screen separator shown in FIG. 1.

Turning in detail to the drawings, the illustrated preferred embodiment demonstrates a circular vibratory screen separator. This separator includes a housing, generally designated 2, which is cylindrical in this embodiment. By means of resilient members, e.g., springs, which are not shown in the drawings, the separator housing 2 is mounted to a base, also not illustrated, in a conventional manner.

The separator housing 2 generally includes a first wall portion 3 and second wall portion 4 located above the first wall portion 3. The first wall portion 3 has an upper edge 5 and the second wall portion 4 has a lower edge 6. The upper and lower edges are mutually aligned and define a seat 7 for holding a screen comprising a taut screen cloth 23, a screen frame 8 and a gasket 24 (see FIG. 4) within the seat 7.

A motor, not shown in the drawings, is fixed within a lower housing 1 fixed to the lower wall portion 3. Eccentric weights are mounted to the motor within the lower housing 1 to generate appropriate vibration. Through rotation of the motor the separator housing is vibrated to enhance screening within a screening cavity 9.

Figure 3A:
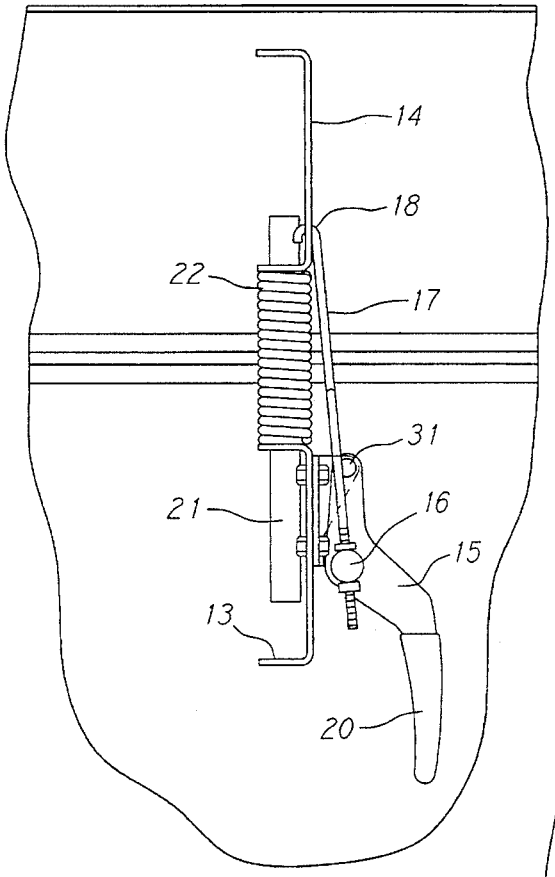
FIG. 3A is a partly cut away side view in the direction "Y" illustrated in FIG. 2, showing the vibratory screen separator in a closed position.
Figure 4:
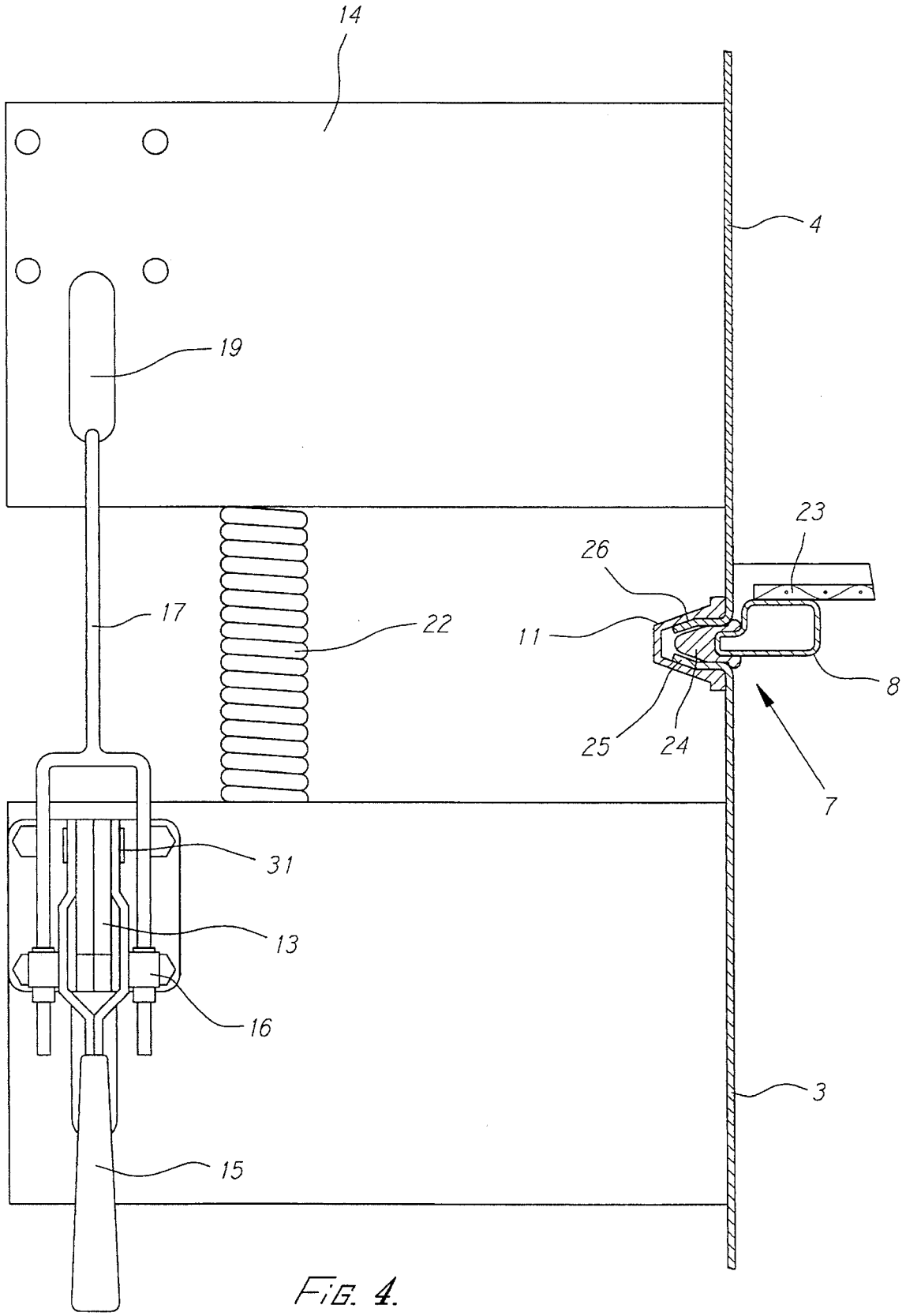
FIG. 4 is a side view in the direction "X" as indicated in FIG. 2 showing the vibratory screen separator in the open position.

In the position shown in FIGS. 1, 3A and 4 the vibratory screen separator is in the first or closed position. In this first position the second wall portion 4 and the first wall portion 3 are pressed toward one another by means of three mounts generally designated 10, and by a clamp band, generally designated 11. Each of the mounts includes a first bracket 13 mounted to the first wall portion 3, and a second bracket 14 mounted to the second wall portion 4 with a compression spring 22 and an over center latch mechanism. The mounts may assume alternate forms such as including pneumatic cylinders. With such a mechanism, a clamp band may be sufficient without latches.

Figure 3B:
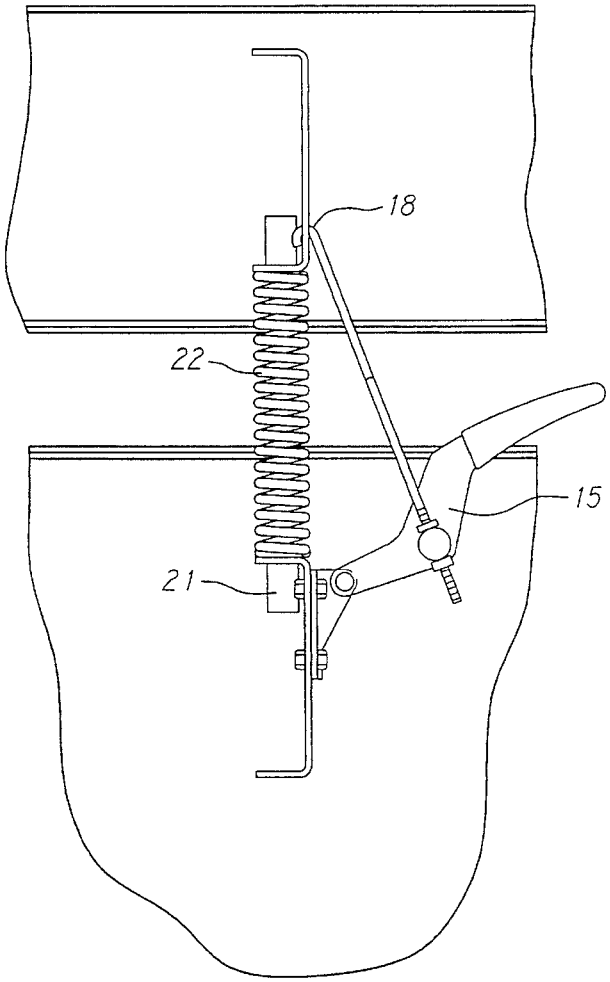
FIG. 3B is a partly cut away side view similar to FIG. 3A but showing the vibratory screen separator in an open position.

Further details concerning the mounts 10 are shown in FIGS. 3A, 3B and 4. The latch includes a tension lever 15 provided and pivotally connected to the first bracket 13 by means of a pivot shaft 16. As shown in FIG. 4, the pivot shaft 16 is pivotally connected to the tension member 17, the one end of which is forked shaped. The pivot shaft 16 in turn is pivotally connected to the tension lever 15. A further pivot shaft 31 spaced with respect to the above mentioned pivot shaft 16 is provided and pivotally connects the tension lever 15 with the first bracket 13.

The other end of the tension member 17 is provided with a hook 18. In the first position shown in FIG. 3A the hook is engaged with an aperture 19 which is formed in the second bracket 14. In this position, the tension lever 15 is swiveled to the lowermost position, i.e. the handle 20 is in a substantially vertical position and the free end of the handle points in a downward direction.

A guiding rod 21 is fixed to the second bracket 14 and slidably engaged with the first bracket 13. A compression spring 22 is disposed on the guiding rod 21 in a manner such that it is enveloping the guiding rod 21. One end of the compression spring 22 abuts against the second wall portion 14 while the other end of the compression spring 22 abuts against the first bracket 13. In the first position shown in FIG. 3A, the compression spring 22 is compressed and the guiding rod 21 extends to its lowermost position relative to the first bracket 13.

In this first position, the latch is locked. The tension lever 15 is positioned with respect to the tension member 17 such that the direction of the tension force passes inwardly of the pivot shaft 31. This results in an over center latch arrangement such that force is required to draw the tension lever 15 across the pivot shaft 31. Once across the pivot shaft 31, the latch is released. Thus, the position shown in FIG. 3A is stable even under vibratory conditions.

As already mentioned, FIG. 3B shows the second position in which the second wall portion 4 and the first wall portion 3 are mutually displaced and the compression spring 22 is substantially relaxed. The guiding rod 21 moves upwardly to an uppermost position with respect to the first bracket 13. The hook 18 is still engaged with the aperture 19, but the tension member 17 is no longer loaded. The tension lever 15 is pivoted to its uppermost position while the handle 20 is disposed in a slightly upwardly inclined position. If the tension lever 15 is further pivoted in a counter-clockwise direction as seen in FIG. 3B, the hook 18 may be disengaged with respect to the aperture, making it is possible to remove the upper second wall portion completely.

Returning to the first position, FIG. 4 shows the structure with the screen 23 mounted. In this position the screen frame 8 is fixed with the gasket in the vibratory screen separator. The upper and lower edges 5 and 6 are flange-shaped, each having a slightly inclined portion 25 or 26 at the outermost periphery. The gasket 24 is sandwiches between the flange-shaped upper and lower edges 5 and 6, respectively. By means of the mounts, the second and first wall portions 3 and 4, respectively, and hence the upper and lower flange-shaped edges 5 and 6, respectively, are pressed against the gasket 24 deforming it to a certain extent. The clamp band 11 surrounds the upper and lower edges 5 and 6, pressing these edges 5, 6 somewhat tighter against the gasket 24.

In the following, a method of handling a vibratory screen separator by an operator is described. At first, the second wall portion 4 and the first wall portion 3 are disposed in their second position, i.e. these wall portions are mutually displaced from each other. The compression spring 22 is substantially relaxed in this position, only compressed by the weight of the device. The screen-structure comprising the screen cloth 23, the screen frame 8 and the gasket 24, may be removed from the whole vibratory screen separator. The screen-structure may then be slid radially between the first wall portion 3 and the second wall portion 4. The compression springs 22 and the guiding rods 21 are disposed in such a position that it is possible to radially slide the screen-structure into the vibratory screen separator without interfering with the mounts 10. The screen-structure is disposed in its final position when the gasket 24 rests on the flange-shaped lower edge 5. The tension lever 15 is pivoted clockwise until the first or closed position shown in FIG. 3A and FIG. 4 is reached. Then the clamp band 11 is tied around the first and second wall portions 3 and 4, pressing the flange-shaped upper and lower edges 5 and 6 still tighter against the gasket 24. The clamp band 11 might be tensioned by means of another tension lever means, generally indicated at 27, or by any other appropriate tension means such as screws or the like. The special benefit of a tension lever means 27 is that it is easy and quick to handle.

Once assembled, the motor is energized and material to be screened is fed into the screening cavity 9. The oversized material remaining on the screen is removed by means of an access through the screening cavity 9, not shown.

For removing the whole screening structure, the clamp band 11 is loosened and then the tension levers 15 are pivoted until they reach the position shown in FIG. 3B. The compression springs 22 urge the second wall portion 4 automatically into the position shown in FIG. 3B when the tension lever 15 is pivoted counter-clockwise until it finally has reached the position shown in FIG. 3B. It is not necessary to loosen the three mounts 10 simultaneously so that they can conveniently be loosened one by one. Then, the screen-structure comprising the screen cloth 23, the screen frame 8, and the gasket 24 can be slid radially outwardly.

For the reason of dismounting the whole second wall portion 4, the hooks 18 can be disengaged with respect to the apertures 19 in the second position shown in FIG. 3B and 4. Then, the guiding rods 21 can be displaced from the first bracket 13 in the upper direction and the compression springs can be displaced from the guiding rod in the downward direction. Vice versa, the springs 22 can be mounted to the guiding rods 18 again and the second wall portion 4 can be mounted to the first wall portion 3 again.

According to this embodiment, additional supporting rods 28 are mounted to the first wall portion 3 with a first end thereof, and mounted to a center member 29 with a second end thereof. The screen 23 can be provided with a center piece 30 which fits to the center member 29. By means of this advantageous structure, the screen is supported more rigidly and hence protected against damage.

Thus, an improved screening system is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced apart from said first position and the screen frame released.

2. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced apart from said first position and the screen frame released, said mounts each include a resilient member between said first and second wall portions substantially relaxed in said second position and under compression in said first position and a latch between said first and second wall portions released in said second position and locked in said first position.

3. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced apart from said first position and the screen frame released, said mounts each include a resilient member between said first and second wall portions substantially relaxed in said second position and under compression in said first position and a latch between said first and second wall portions released in said second position and locked in said first position, said mounts each further include a first bracket on said first wall portion and a second bracket on said second wall portion, said resilient member and said latch each extending between a said first bracket and a said second, bracket, respectively.

4. The vibratory screen separator of claim 3 wherein three of said first and three of said second brackets are provided, the linear distance between two said first brackets being greater than the maximum width dimension of the screen.

5. The vibratory screen separator of claim 2 wherein said latches are over center latches.

6. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced apart from said first position and the screen frame released, said mounts each including a resilient member between said first and second wall portions substantially relaxed in said second position and under compression in said first position, a latch between said first and second wall portions released in said second position and locked in said first position, a first bracket on said first wall portion and a second bracket on said second wall portion, said resilient member and said latch each extending between a said first bracket and a said second bracket, respectively, each said latch including a tension lever linked at one end to one of said first and second brackets and being provided at its other end with a handle and a tension member, a first end of said tension member being pivotally connected to the tension lever in the middle part thereof, a second end of said tension member being pivotally connected to the other of said first and second brackets.

7. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced apart from said first position and the screen frame released, said mounts each including a resilient member between said first and second wall portions substantially relaxed in said second position and under compression in said first position and a latch between said first and second wall portions released in said second position and locked in said first position;

a clamp band, said first and second wall portions being circular and said upper and lower edges, respectively, being provided with outwardly extending flanges, said clamp band gripping said outwardly extending flanges.

8. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced from said first position and the screen frame released, each said mount including a resilient member between said first and second wall portions substantially relaxed in said second position and under compression in said first position, a latch between said first and second wall portions released in said second position and locked in said first position, a first bracket on said first wall portion and a second bracket on said second wall portion, said resilient member and said latch each extending between a said first bracket and a said second bracket, respectively, each said latch including a tension lever linked at one end to one of said first and second bracket and being provided at its other end with a handle, and a tension member, a first end of said tension member being pivotally connected to the tension lever in the middle part thereof, a second end of said tension member being pivotally connected to the other of said first and second brackets.

9. The vibratory screen separator of claim 8 wherein said second end of said tension member is provided with a hook, the other of said first and second bracket being provided with an aperture to receive said hook.

10. A vibratory screen separator using screens with screen frames, comprising a resiliently mounted housing including a first wall portion having an upper edge and a second wall portion above said first wall portion and having a lower edge, said upper and lower edges being mutually aligned and defining a seat therebetween to receive a screen frame;

mounts, each said mount being coupled to said first and second wall portions and having a first position with said upper and lower edges gripping the screen frame and a second position with said upper and lower edges mutually displaced from said first position and the screen frame released, each said mount including a resilient member between said first and second wall portions substantially relaxed in said second position and under compression in said first position and a latch between said first and second wall portions released in said second position and locked in said first position;

a clamp band, said first and second wall portions being circular and said upper and lower edges, respectively, being provided with outwardly extending flanges, said clamp band gripping said outwardly extending flanges.

11. The vibratory screen separator of claim 10 further comprising a resiliently deformable gasket having a substantially V-shaped crossed section positioned about the outer periphery of the screen frame;

said outwardly extending flanges being inclined with respect to each other sandwiching said gasket therebetween in said first position;

said clamp band being tensioned in said first position pressing said flanges against the gasket in a tight and sealing manner.

12. The vibratory screen separator of claim 11 wherein the clamp band is provided with an over center latch having a tension lever.

* * * * *